US011525238B2

(12) United States Patent
Myers et al.

(10) Patent No.: US 11,525,238 B2
(45) **Date of Patent: *Dec. 13, 2022**

(54) STABILITY CONTROL FOR HYDRAULIC WORK MACHINE

(71) Applicant: Deere & Company, Moline, IL (US)

(72) Inventors: David J. Myers, Dubuque, IA (US); Doug M. Lehmann, Bellevue, IA (US)

(73) Assignee: DEERE & COMPANY, Moline, IL (US)

( * ) Notice: Subject to any disclaimer, the term of this patent is extended or adjusted under 35 U.S.C. 154(b) by 699 days.

This patent is subject to a terminal disclaimer.

(21) Appl. No.: 15/908,565

(22) Filed: Feb. 28, 2018

(65) Prior Publication Data

US 2019/0264419 A1 Aug. 29, 2019

(51) Int. Cl.
*E02F 9/22* (2006.01)
*E02F 3/42* (2006.01)
(Continued)

(52) U.S. Cl.
CPC ..... *E02F 3/422* (2013.01); *E02F 3/283* (2013.01); *E02F 9/2228* (2013.01);
(Continued)

(58) Field of Classification Search
CPC . E02F 3/283; E02F 3/342; E02F 3/422; E02F 9/2228; E02F 9/26; E02F 9/264
See application file for complete search history.

(56) References Cited

U.S. PATENT DOCUMENTS 5,180,028 A 1/1993 Perrenoud, Jr.
5,692,376 A 12/1997 Miki et al.
(Continued)

FOREIGN PATENT DOCUMENTS

CN 103026076 A 4/2013
CN 103403271 A 11/2013
(Continued)

OTHER PUBLICATIONS

U.S. Appl. No. 16/182,106, filed Nov. 6, 2018, by Myers et al.
(Continued)

*Primary Examiner* — Hunter B Lonsberry
*Assistant Examiner* — Matthew J. Reda
(74) *Attorney, Agent, or Firm* — Michael Best & Friedrich LLP

(57) ABSTRACT

A work machine includes a mechanical arm. A work implement is coupled to the mechanical arm to receive a load. A hydraulic actuator moves the arm between a lower position and an upper position, wherein a distance between the lower position and the upper position is a travel distance of the mechanical arm. A sensor unit is configured to sense the load in the work implement. A valve is in fluid communication with the hydraulic actuator for supplying a fluid output to the hydraulic actuator. A controller is in communication with the valve and the sensor unit. The controller is configured to transmit a control signal to the valve to adjust the fluid output to the hydraulic actuator. The controller is also configured to adjust the upper position to reduce the travel distance in response to the load being at or above a threshold value.

19 Claims, 8 Drawing Sheets

(51) Int. Cl.
*E02F 3/28* (2006.01)
*E02F 3/342* (2006.01)

(52) U.S. Cl.
CPC ..... *E02F 9/2267* (2013.01); *E02F 9/2271* (2013.01); *E02F 3/342* (2013.01)

(56) References Cited

U.S. PATENT DOCUMENTS

| | | | | |
|---|---|---|---|---|
| 6,047,228 | A | 4/2000 | Stone et al. | |
| 6,175,796 | B1 | 1/2001 | Ishikawa | |
| 6,437,701 | B1 | 8/2002 | Muller | |
| 6,615,581 | B2 | 9/2003 | Kusuyama | |
| 6,766,236 | B1 | 7/2004 | Lamela et al. | |
| 6,802,687 | B2 | 10/2004 | Litchfield et al. | |
| 6,868,672 | B2 | 3/2005 | Luo | |
| 7,276,669 | B2 | 10/2007 | Dahl et al. | |
| 7,518,523 | B2 | 4/2009 | Yuan et al. | |
| 7,610,136 | B2 | 10/2009 | Okamura et al. | |
| 7,630,793 | B2 | 12/2009 | Thomas et al. | |
| 8,751,117 | B2 | 6/2014 | Ekvall et al. | |
| 9,068,323 | B2 | 6/2015 | Peterson et al. | |
| 9,074,352 | B2 | 7/2015 | Ramun | |
| 9,206,026 | B2 | 12/2015 | Aulton et al. | |
| 9,238,903 | B2 | 1/2016 | Saito | |
| 9,593,461 | B2 | 3/2017 | Faivre et al. | |
| 9,822,507 | B2 | 11/2017 | Singh et al. | |
| 2006/0108185 | A1 | 5/2006 | Bitter | |
| 2008/0201043 | A1 | 8/2008 | Sahlin et al. | |
| 2008/0234902 | A1 | 9/2008 | Johnson et al. | |
| 2009/0082930 | A1 | 3/2009 | Peters | |
| 2009/0171482 | A1 | 7/2009 | Mindeman et al. | |
| 2010/0204891 | A1* | 8/2010 | Biggerstaff | E02F 3/3414 701/50 |
| 2010/0268410 | A1 | 10/2010 | Vigholm et al. | |
| 2011/0046857 | A1 | 2/2011 | Farmer et al. | |
| 2012/0291427 | A1 | 11/2012 | Azuma et al. | |
| 2013/0226415 | A1* | 8/2013 | Smith | E02F 9/2235 701/50 |
| 2013/0228070 | A1 | 9/2013 | Kim | |
| 2013/0318952 | A1 | 12/2013 | Park et al. | |
| 2013/0345939 | A1* | 12/2013 | Magaki | E02F 3/435 701/50 |
| 2014/0088839 | A1 | 3/2014 | Magaki et al. | |
| 2014/0121840 | A1 | 5/2014 | Mizuochi et al. | |
| 2014/0320293 | A1* | 10/2014 | Hunter, Jr. | G01L 19/12 340/626 |
| 2015/0368080 | A1 | 12/2015 | Dal Dosso et al. | |
| 2016/0281323 | A1* | 9/2016 | Imaizumi | E02F 9/0841 |
| 2016/0281331 | A1 | 9/2016 | Ikegami et al. | |
| 2016/0312432 | A1 | 10/2016 | Wang et al. | |
| 2017/0050643 | A1* | 2/2017 | Lambert | B60P 1/045 |
| 2017/0121929 | A1 | 5/2017 | Martinez | |
| 2017/0191245 | A1 | 7/2017 | Shatters et al. | |
| 2017/0211597 | A1 | 7/2017 | Vigholm et al. | |
| 2017/0284056 | A1 | 10/2017 | Mizuochi et al. | |
| 2018/0087242 | A1* | 3/2018 | Mitchell | B62D 6/02 |
| 2018/0327238 | A1 | 11/2018 | Tremblay | |
| 2019/0010965 | A1 | 1/2019 | Green et al. | |
| 2019/0024345 | A1 | 1/2019 | Thomsen et al. | |
| 2019/0264418 | A1* | 8/2019 | Myers | E02F 9/2267 |
| 2019/0264422 | A1* | 8/2019 | Kenkel | E02F 3/422 |

FOREIGN PATENT DOCUMENTS

| | | | |
|---|---|---|---|
| CN | 105035776 | A | 11/2015 |
| CN | 106245706 | A | 12/2016 |
| CN | 107268702 | A | 10/2017 |
| DE | 19510375 | A1 | 9/1995 |
| DE | 19901563 | A1 | 7/2000 |
| DE | 10163066 | A1 | 7/2003 |
| DE | 102007045846 | A1 | 4/2009 |
| DE | 102008012301 | A1 | 9/2009 |
| DE | 112010003335 | T5 | 8/2012 |
| DE | 112012003346 | B4 | 1/2017 |
| EP | 0229083 | B1 | 7/1987 |
| EP | 1862599 | B1 | 7/2013 |
| JP | H03-8929 | | 1/1991 |
| WO | 2014110336 | A1 | 7/2014 |
| WO | WO2016152994 | A1 | 7/2017 |

OTHER PUBLICATIONS

U.S. Appl. No. 15/908,574, filed Feb. 28, 2018, by Kenkel et al.
U.S. Appl. No. 15/908,555, filed Feb. 28, 2018, by Myers et al.
U.S. Appl. No. 15/908,581, filed Feb. 28, 2018, by Henn et al.
U.S. Appl. No. 15/908,583, filed Feb. 28, 2018, by Lehmann et al.
U.S. Appl. No. 15/908,561, filed Feb. 28, 2018, by Kenkel et al.
Hassan et al. "An Experimental Study Into The Effect Of Temperature And Pressure on The Hydraulic System" Eng. & Tech. Journal, 2009, 27(14):12531-2545.
German Patent Office Examination Report for Application No. 102019202654.0 dated Dec. 18, 2019 (11 pages, statement of relevance included).
German Patent Office Examination Report for Application No. 102019202754.7 dated Dec. 20, 2019 (11 pages, statement of relevance included).
German Patent Office Examination Report for Application No. 102019202746.6 dated Jan. 29, 2020 (11 pages, statement of relevance included).
Chinese Office Action issued in application No. 201910155022.8 dated Nov. 10, 2021 (13 pages).

* cited by examiner

STABILITY CONTROL FOR HYDRAULIC WORK MACHINE

FIELD

The disclosure relates to a hydraulic system for a work vehicle.

BACKGROUND

Many industrial work machines, such as construction equipment, use hydraulics to control various moveable implements. The operator is provided with one or more input or control devices operably coupled to one or more hydraulic actuators, which manipulate the relative location of select components or devices of the equipment to perform various operations. For example, loaders may be utilized in lifting and moving various materials. A loader may include a bucket or fork attachment pivotally coupled by a boom to a frame. One or more hydraulic cylinders are coupled to the boom and/or the bucket to move the bucket between positions relative to the frame.

SUMMARY

According to an exemplary embodiment a work machine includes a mechanical arm. A work implement is coupled to the mechanical arm and configured to receive a load. A hydraulic actuator is coupled to the mechanical arm to move the arm between a lower position and an upper position, wherein a distance between the lower position and the upper position is a travel distance of the mechanical arm. A sensor unit is configured to sense the load in the work implement. A valve is in fluid communication with the hydraulic actuator for supplying a fluid output to the hydraulic actuator. A controller is in communication with the valve and the sensor unit. The controller is configured to transmit a control signal to the valve to adjust the fluid output to the hydraulic actuator. The controller is also configured to adjust the upper position to reduce the travel distance in response to the load being at or above a threshold value.

According to another exemplary embodiment a work machine includes a mechanical arm. A work implement is coupled to the mechanical arm and configured to receive a load. A hydraulic actuator is coupled to the mechanical arm to move the arm between a lower position and an upper position, wherein a distance between the lower position and the upper position is a travel distance of the mechanical arm. A load sensor configured to detect the load in the work implement. A position sensor configured to detect the position of the mechanical arm. A valve is in fluid communication with the hydraulic actuator for supplying a fluid output to the hydraulic actuator. A controller is in communication with the valve, the load sensor, and the position sensor. The controller is configured to adjust the upper position to reduce the travel distance in response to the load being at or above a load threshold value. The controller is configured to determine if the mechanical arm is within an upper portion of the reduced travel distance and to derate the fluid output of the valve when the mechanical arm is in the upper portion of the reduced travel distance.

Another exemplary embodiment includes a method of controlling stability during operation of a work vehicle. The work vehicle includes a mechanical arm. A work implement is coupled to the mechanical arm and configured to receive a load. A hydraulic actuator is coupled to the mechanical arm to move the arm between a lower position and an upper position, wherein a distance between the lower position and the upper position is a travel distance of the mechanical arm. A sensor unit. A valve in fluid communication with the hydraulic actuator for supplying a fluid output to the hydraulic actuator. A request is received to move the mechanical arm from an operator input. A work implement load value is received from the a sensor unit. It is determined if the load value is at or above a load threshold value. The upper position of the mechanical arm is adjusted to reduce the travel distance in response to the load being at or above a threshold value.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

FIGS. 1-5 illustrate an exemplary embodiment of a work machine depicted as a loader 10. The present disclosure is not limited, however, to a loader and may extend to other industrial machines such as an excavator, crawler, harvester, skidder, backhoe, feller buncher, motor grader, or any other work machine. As such, while the figures and forthcoming description may relate to an loader, it is to be understood that the scope of the present disclosure extends beyond a loader and, where applicable, the term "machine" or "work machine" will be used instead. The term "machine" or "work machine" is intended to be broader and encompass other vehicles besides a loader for purposes of this disclosure.

Figure 1:
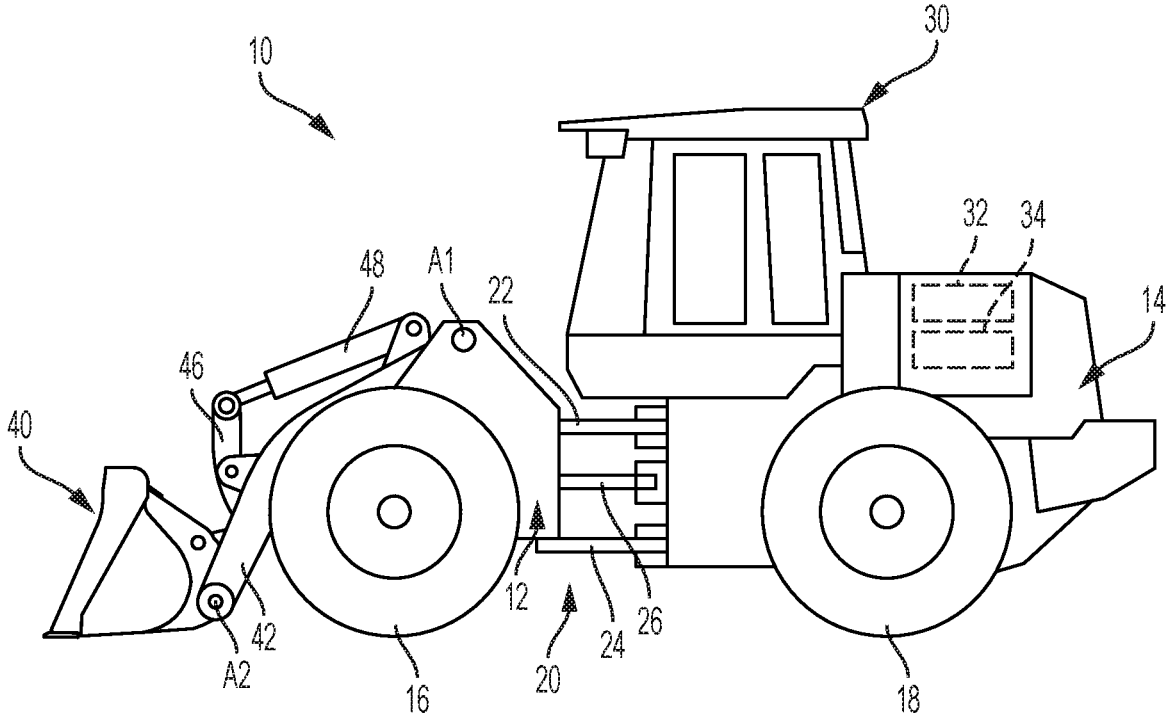
FIG. 1 is a side view of an exemplary work machine with a work implement in a lowered position.

FIG. 1 shows a wheel loader 10 having a front body section 12 with a front frame and a rear body section 14 with a rear frame. The front body section 12 includes a set of front wheels 16 and the rear body section 14 includes a set of rear wheels 18, with one front wheel 16 and one rear wheel 18 positioned on each side of the loader 10. Different embodiments can include different ground engaging members, such as treads or tracks.

The front and rear body sections 12, 14 are connected to each other by an articulation connection 20 so the front and rear body sections 12, 14 can pivot in relation to each other about a vertical axis (orthogonal to the direction of travel and the wheel axis). The articulation connection 20 includes one or more upper connection arms 22, one or more lower connection arms 24, and a pair of articulation cylinders 26 (one shown), with one articulation cylinder 26 on each side of the loader 10. Pivoting movement of the front body 12 is achieved by extending and retracting the piston rods in the articulation cylinders 26.

The rear body section 14 includes an operator cab 30 in which the operator controls the loader 10. A control system (not shown) is positioned in the cab 30 and can include different combinations of a steering wheel, control levers, joysticks, control pedals, and control buttons. The operator can actuate one or more controls of the control system for purposes of operating movement of the loader 10 and the different loader components. The rear body section 14 also contains a prime mover 32 and a control system 34. The prime mover 32 can include an engine, such as a diesel engine and the control system 34 can include a vehicle control unit (VCU).

A work implement 40 is moveably connected to the front body section 12 by one or more boom arms 42. The work implement 40 is used for handling and/or moving objects or material. In the illustrated embodiment, the work implement 40 is depicted as a bucket, although other implements, such as a fork assembly, can also be used. A boom arm can be positioned on each side of the work implement 40. Only a single boom arm is shown in the provided side views and referred to herein as the boom 42. Various embodiments can include a single boom arm or more than two boom arms. The boom 42 is pivotably connected to the frame of the front body section 12 about a first pivot axis A1 and the work implement 40 is pivotably connected to the boom 42 about a second pivot Axis A2.

Figure 2:
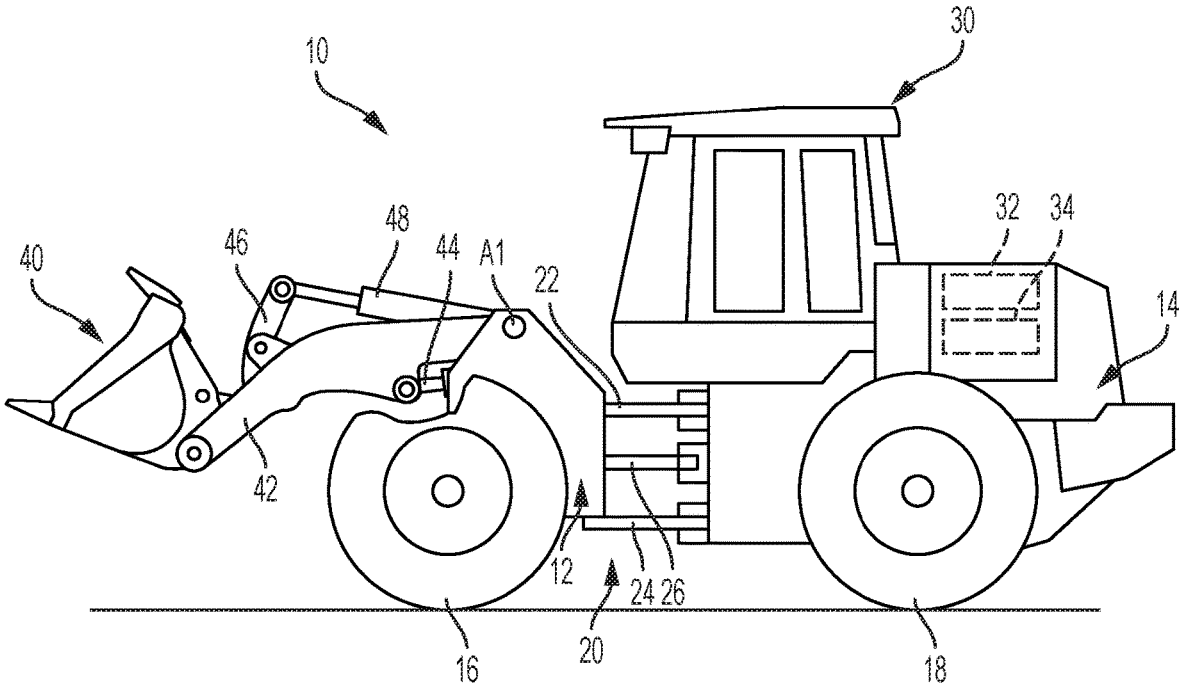
FIG. 2 is a side view of the work machine of FIG. 1 with the work implement in a partially raised position.
Figure 3:
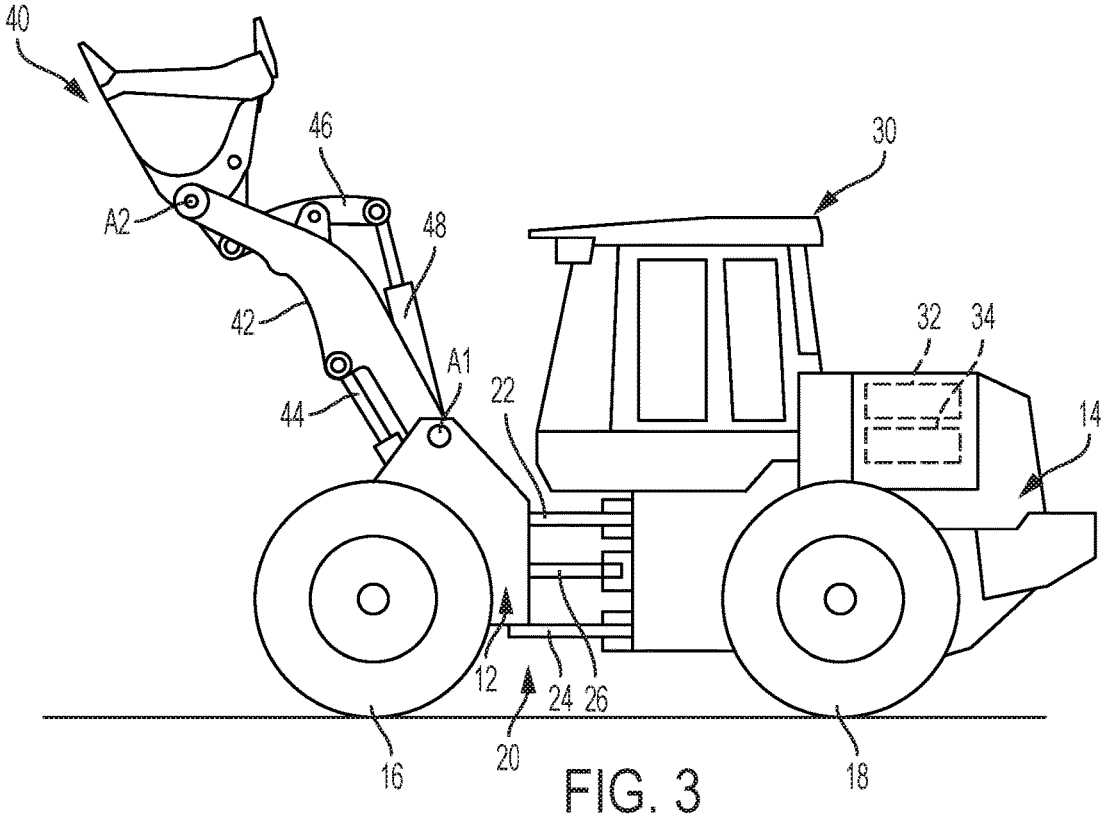
FIG. 3 is a side view of the work machine of FIG. 1 with the work implement in a fully raised positon.
Figure 4:
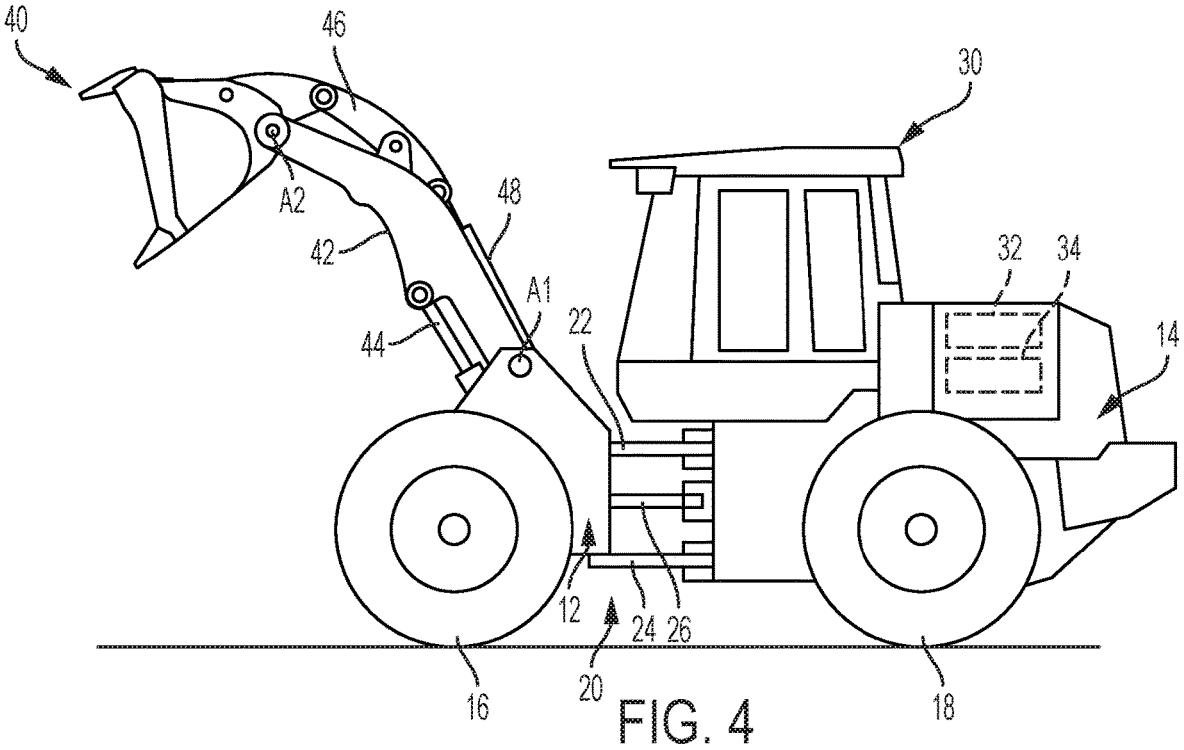
FIG. 4 is a side view of the work machine of FIG. 1 with the work implement in a fully raised and tilted position.

As best shown in FIGS. 2-4, one or more boom hydraulic cylinders 44 are mounted to the frame of the front body section 12 and connect to the boom 42. Generally, two hydraulic cylinders 44 are used with one on each side connected to each boom arm, although the loader 10 may have any number of boom hydraulic cylinders 44, such as one, three, four, etc. The boom hydraulic cylinders 44 can be extended or retracted to raise or lower the boom 42 to adjust the vertical position of the work implement 40 relative to the front body section 12.

One or more pivot linkages 46 are connected to the work implement 40 and to the boom 42. One or more pivot hydraulic cylinders 48 are mounted to the boom 42 and connect to a respective pivot linkage 46. Generally, two pivot hydraulic cylinders 48 are used with one on each side connected to each boom arm, although the loader 10 may have any number of pivot hydraulic cylinders 48. The pivot hydraulic cylinders 48 can be extended or retracted to rotate the work implement 40 about the second pivot axis A2, as shown, for example, in FIGS. 3 and 4. In some embodiments, the work implement 40 may be moved in different manners and a different number or configuration of hydraulic cylinders or other actuators may be used.

Figure 5:
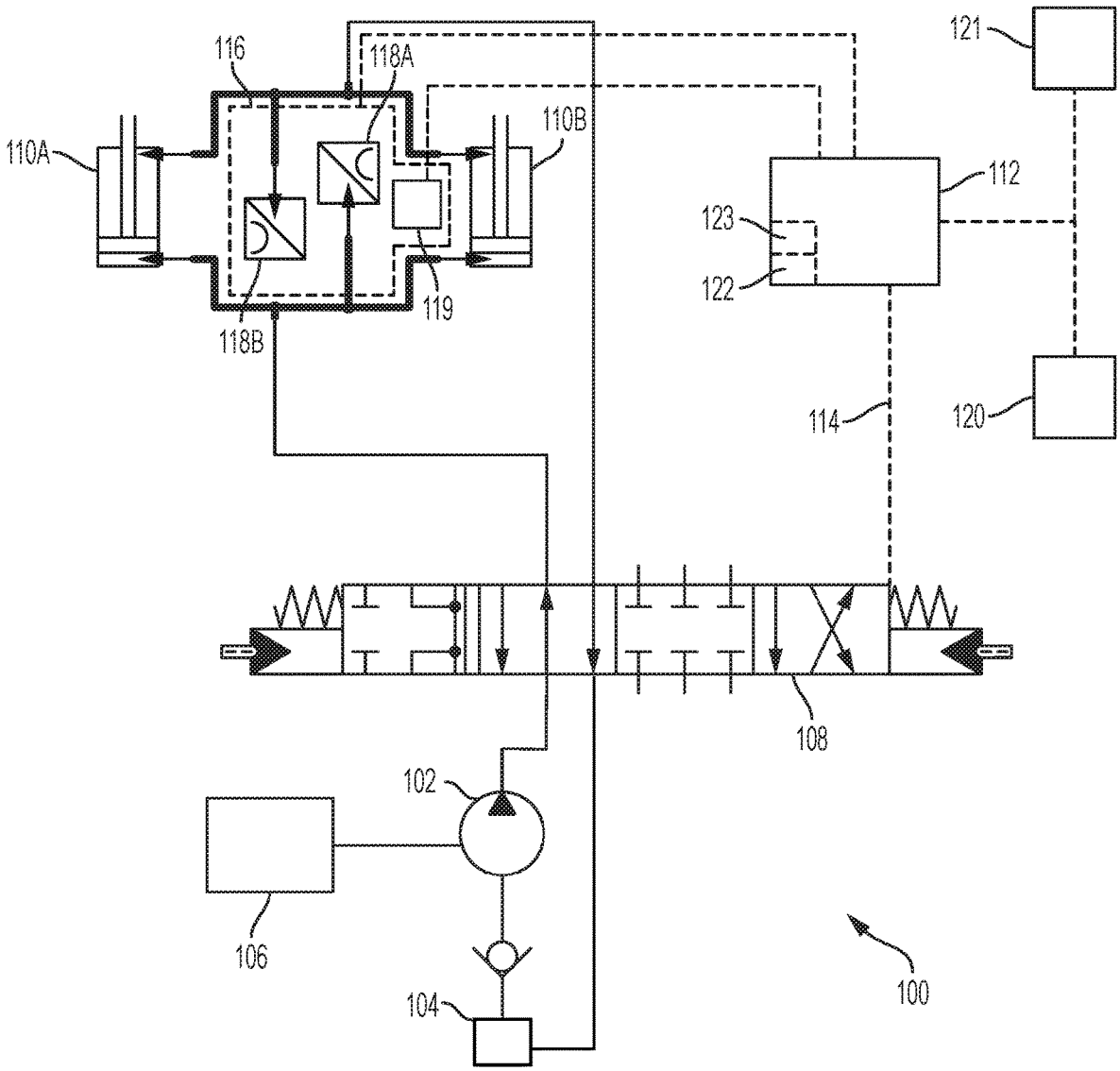
FIG. 5 is a hydraulic system schematic for an exemplary work vehicle.

FIG. 5 illustrates a partial schematic of an exemplary embodiment of a hydraulic and control system 100 configured to supply fluid to implements in the loader 10 shown in FIGS. 1-4, although it can be adapted be used with other work machines as mentioned above. A basic layout of a portion of the hydraulic system 100 is shown for clarity and one of ordinary skill in the art will understand that different hydraulic, mechanical, and electrical components can be used depending on the machine and the moveable implements.

The hydraulic system 100 includes at least one pump 102 that receives fluid, for example hydraulic oil, from a reservoir 104 and supplies fluid to one or more downstream components at a desired system pressure. The pump 102 is powered by an engine 106. The pump 102 can be capable of providing an adjustable output, for example a variable displacement pump or variable delivery pump. Although only a single pump 102 is shown, two or more pumps may be used depending on the requirements of the system and the work machine.

For simplicity, the illustrated embodiment depicts the pump 102 delivering fluid to a single valve 108. In an exemplary embodiment, the valve 108 is an electrohydraulic valve that receives hydraulic fluid from the pump and delivers the hydraulic fluid to a pair of actuators 110A, 110B. The actuators 110A, 110B can be representative of the boom cylinders 44 shown in FIGS. 2-4 or may be any other suitable type of hydraulic actuator known to one of ordinary skill in the art. FIG. 5 shows an exemplary embodiment of two double-acting hydraulic actuators 110A, 110B. Each of the double-acting actuators 110A, 110B includes a first chamber and a second chamber. Fluid is selectively delivered to the first or second chamber by the associated valve 108 to extend or retract the actuator piston. The actuators 110A, 110B can be in fluid communication with the reservoir 104 so that fluid leaving the actuators 110A, 110B drains to the reservoir 104.

The hydraulic system 100 includes a controller 112. In an exemplary embodiment, the controller 112 is a Vehicle Control Unit ("VCU") although other suitable controllers can also be used. The controller 112 includes a plurality of inputs and outputs that are used to receive and transmit information and commands to and from different components in the loader 10. Communication between the controller 112 and the different components can be accomplished through a CAN bus, other communication link (e.g., wireless transceivers), or through a direct connection. Other conventional communication protocols may include J1587 data bus, J1939 data bus, IESCAN data bus, etc.

The controller 112 includes memory for storing software, logic, algorithms, programs, a set of instructions, etc. for controlling the valve 108 and other components of the loader 10. The controller 112 also includes a processor for carrying out or executing the software, logic, algorithms, programs, set of instructions, etc. stored in the memory. The memory can store look-up tables, graphical representations of various functions, and other data or information for carrying out or executing the software, logic, algorithms, programs, set of instructions, etc.

The controller 112 is in communication with the valve 108 and can send a control signal 114 to the pump 102 to adjust the output or flowrate to the actuators 110A, 110B. The type of control signal and how the valve 108 is adjusted will vary dependent on the system. For example, the valve 108 can be an electrohydraulic servo valve that adjusts the flow rate of hydraulic fluid to the actuators 110A, 110B based on the received control signal 114.

One or more sensor units 116 can be associated with the actuators 110A, 110B. The sensor unit 116 can detect information relating to the actuators 110A, 110B and provide the detected information to the controller 112. For example, one or more sensors can detect information relating to actuator position, cylinder pressure, fluid temperature, or movement speed of the actuators. Although described as a single unit related to the boom arm, the sensor unit 116 can encompass sensors positioned at any position within the work machine or associated with the work machine to detect or record operating information.

FIG. 5 shows an exemplary embodiment where the sensor unit 116 includes a first pressure sensor 118A in communication with the first chamber of the actuators 110A, 110B and a second pressure sensor 118B is in communication with the second chamber of the actuators 110A, 110B. The pressure sensors 118A, 118B are used to measure the load on the actuators 110A, 110B. In an exemplary embodiment, the pressure sensors 118A, 118B are pressure transducers.

FIG. 5 also shows a position sensor 119 associated with the sensor unit 116. The position sensor 119 is configured to detect or measure the position of the boom 42 and transmit that information to the controller 112. The position sensor 119 can be configured to directly measure the position of the boom 42 or to measure the position of the boom 42 by the position or movement of the actuators 110A, 110B. In an exemplary embodiment, the position sensor 119 can be a rotary position sensor that measures the position of the boom 42. Instead of a rotary position sensor, one or more inertial measurement unit sensors can be used. The position sensor 119 can also be an in-cylinder position sensor that directly measures the position of the hydraulic piston in one or more of the actuators 110A, 110B. The position sensor 119 can also include a work implement position sensor to detect the position and tilt of the work implement 40. Although only a single unit is shown for the position sensor 119, it can represent one or more sensors, including the boom position sensor and the work implement position sensor. Additional sensors may be associated with the sensor unit 116 and one or more additional sensor units can be incorporated into the system 100.

The controller 112 is also in communication with one or more operator input mechanisms 120. The one or more operator input mechanisms 120 can include, for example, a joystick, throttle control mechanism, pedal, lever, switch, or other control mechanism. The operator input mechanisms 120 are located within the cab 30 of the loader 10 and can be used to control the position of the work implement 40 by adjusting the hydraulic actuators 110A, noB. A speed sensor 121 is also in communication with the controller 112 and is configured to provide a vehicle speed to the controller. The speed sensor 121 can be part of the sensor unit 116 or considered separately.

During operation, an operator adjusts the position of the work implement 40 through manipulation of one or more input mechanisms 120. The operator is able to start and stop movement of the work implement 40, and also to control the movement speed of the work implement 40 through acceleration and deceleration. The movement speed of the work implement 40 is partially based on the flow rate of the hydraulic fluid entering the actuators 110A, 110B. The work implement's movement speed will also vary based on the load of the handled material. Raising or lowering an empty bucket can have an initial or standard speed, but when raising or lowering a bucket full of gravel, or a fork supporting a load of lumber, the movement speed of the bucket will be reduced or increased based on the weight of the material.

Instability can also be caused by a load being supported by the work implement in a raised position. For example, a heavier load raised to the highest position of the boom arm 42 can increase the likelihood of the work machine tipping forward. This load instability can be increased by movement of the vehicle in the forward or reverse direction.

According to an exemplary embodiment, the controller 112 is configured to limit the maximum height of the boom 42 based on a detected load and also to derate the flow of the hydraulic fluid to the actuators 110A, 110B. The controller 112 includes a height stability module 122 which includes instructions that will limit the upper position of the boom arm 42, for example by cutting off flow to the hydraulic actuators 110A, 110B. The height stability module 122 can also derate a boom raise command from the operator input mechanism 120 when approaching the maximum height. The height stability module 122 can be turned on or off by an operator, for example through operation of switch or control screen input in the cab 30.

Figure 6:
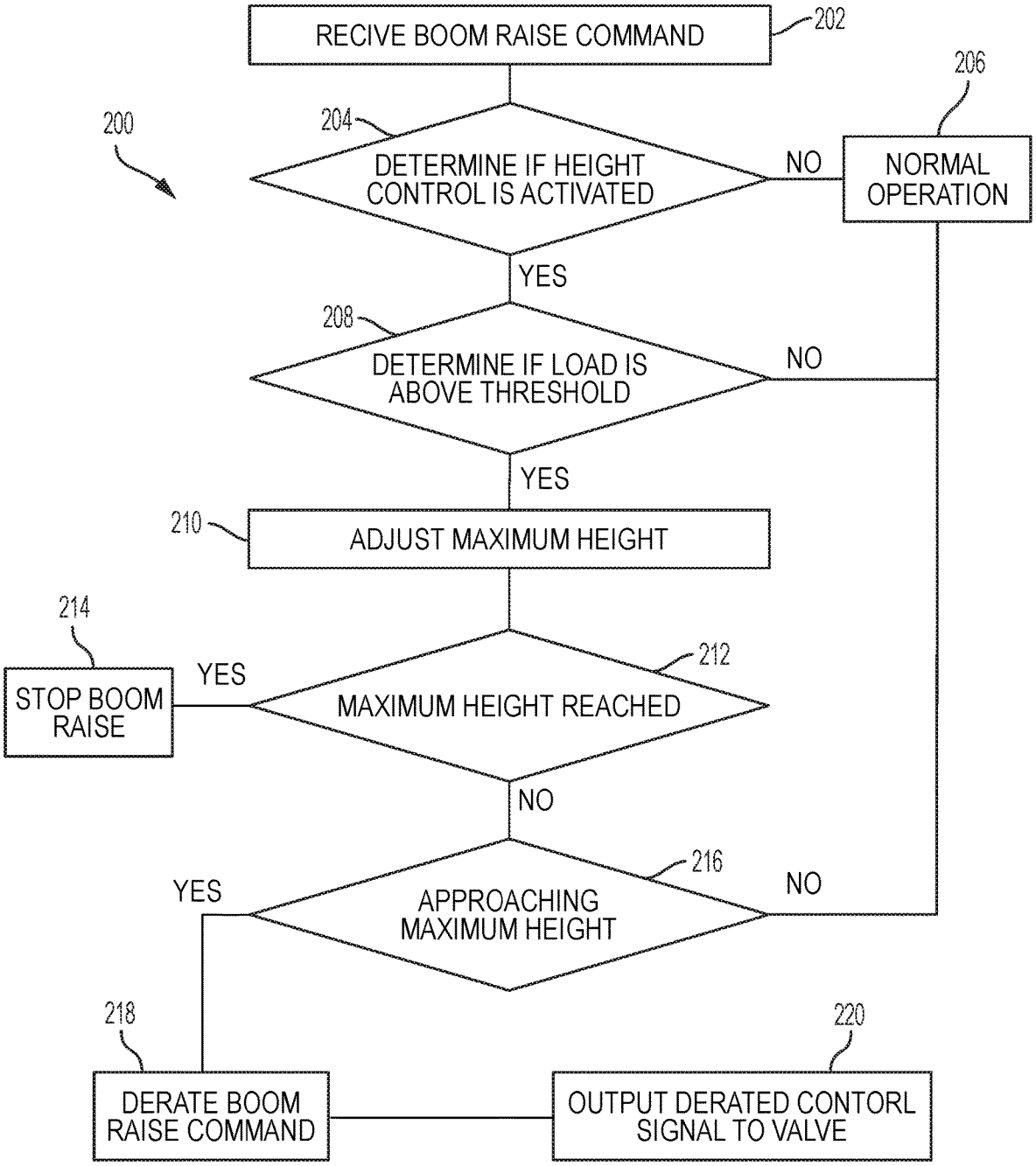
FIG. 6 is a flow chart of an exemplary height stability control module for the hydraulic system.

FIG. 6 shows a partial flow diagram of the instructions 200 to be executed by the controller 112 for the height stability control. Typically, when a boom raise command is received by the controller 112, the controller 112 sends a control signal 114 to the valve 108 to supply fluid to the second chamber of the actuators 110A, 110B, extending the hydraulic pistons. The flow rate of the hydraulic fluid can be based on the force or position of the operator's input, or based on a set rate.

The controller 112 initially receives a boom raise command (step 202) and checks to see if the height stability control is activated (step 204). If the height stability control is not activated, the controller 112 proceeds under normal operation (step 206) and sends the control signal to the valve 108. If the height stability module is activated, the controller 112 determines if the load is above a threshold value (step 208) based on the signal received from the sensor unit 116. If the load is below a threshold value, the controller 112 proceeds under normal operation (step 206) and sends the control signal to the valve 108. If the load is above the threshold value, the controller 112 reduces the maximum height of the boom (step 210). This reduces the upper position of the boom, so that a total travel distance of the boom from a lower position to the upper position is reduced. The controller 112 then determines if the boom has reached the maximum height (step 212). If the maximum height has been reached, the controller 112 stops the boom raise (step 214). The boom raise can be stopped by ignoring the raise command or by derating the flow from the valve 108 to the actuators 110A, 110B, so that there is no movement or movement is minimized. If the maximum height has not been reached, then the controller 112 determines if the boom is approaching the maximum height (step 216). Approaching the maximum can mean that the boom is within a certain percentage of the adjusted maximum height (set in step 210). For example, the boom can be considered to be approaching the maximum height if it is within an upper portion of the travel distance, for example within 50%, 25%, 15%, 10%, or 5% or less of the adjusted or reduced maximum height. If the boom is not approaching the maximum height, the controller 112 proceeds under normal operation (step 206) and sends the control signal to the valve 108. If the boom is approaching the maximum height, the boom raise command is derated (step 218) and the derated control signal is sent to the valve (step 220). When the boom is within the range of approaching maximum height, the boom raise command can be derated a set amount or a variable amount that increases the closer the boom gets to the maximum height.

Figure 7:
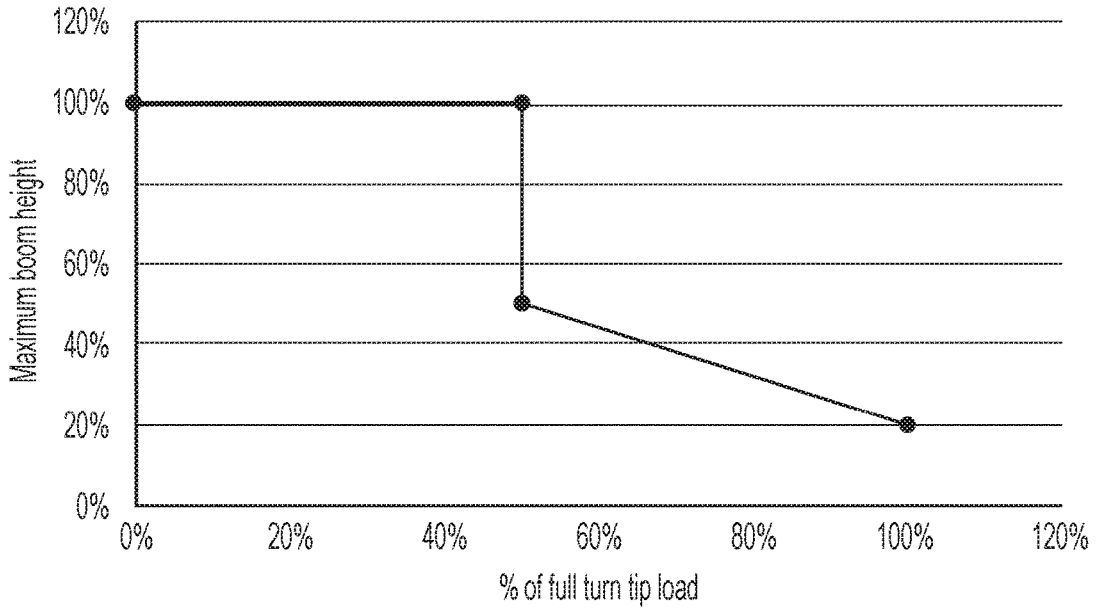
FIG. 7 is a graph showing the control of the boom height relative to load.

FIG. 7 shows a graph depicting an exemplary height adjustment based on the load. At lower loads, for example less than approximately 50% of the maximum load, the maximum boom height is unmodified. At approximately 50% of the maximum load, the maximum boom height decreases, for example to approximately 50% of the original maximum height. As the load increases, the maximum height increases. As shown in FIG. 7, at the maximum load, the maximum height is decreased to approximately 20% of the original maximum. The maximum load can be an established safety value, for example the maximum static load (tipping load) or payload as would be understood by one of ordinary skill in the art.

FIG. 7 depicts a continuous decrease in the maximum height with the increase in the load. In alternative embodiments, incremental set points can be used for adjusting the maximum height, for example set points every 1%, 5%, 10%, etc. from the minimum threshold value can be used. These values and the resulting height adjustments can be stored in a lookup table that is accessed by the controller 112 or the height stability control module 122. Instead of using set values, the controller 112 or height stability control module 122 can contain an alogrithm using a formula that calculates the height adjustment amount based on the load amount received from the sensor unit 116, so that the maximum height will be at least partially continuously varied based on the load, although different loads may result in the same maximum height based on the configuration of the algorithm or rounding. Additionally, the minimum set point or threshold value can be adjusted to be below or above 50%.

Figure 8:
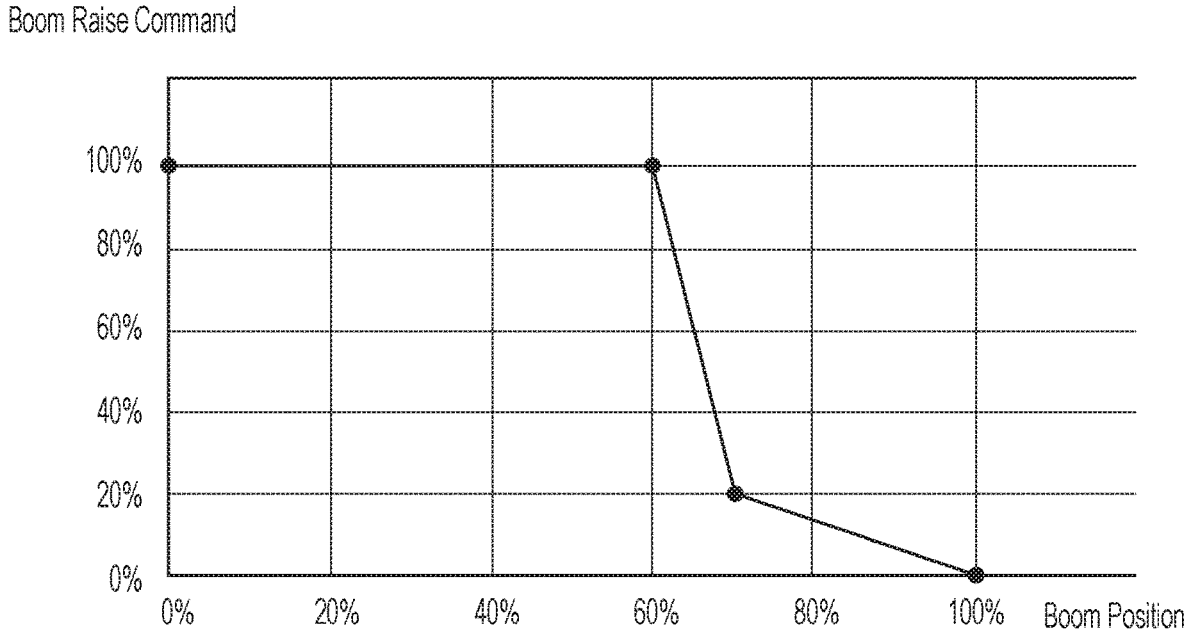
FIG. 8 is graph showing a first example of a deration of a boom raise command relative to the boom height.
Figure 9:
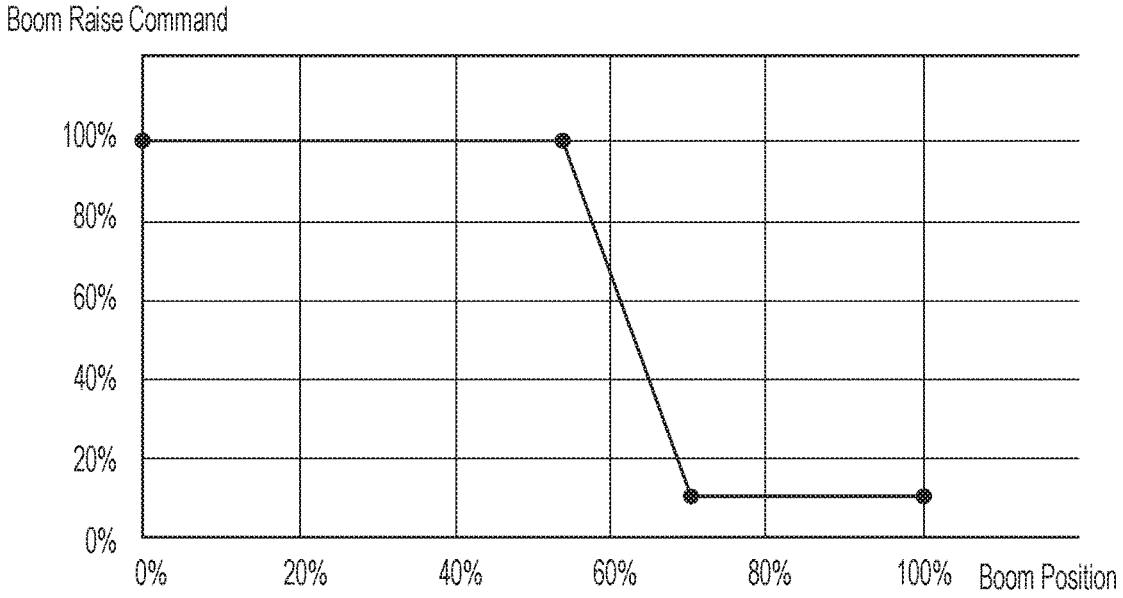
FIG. 9 is graph showing a second example of a deration of a boom raise command relative to the boom height.
Figure 10:
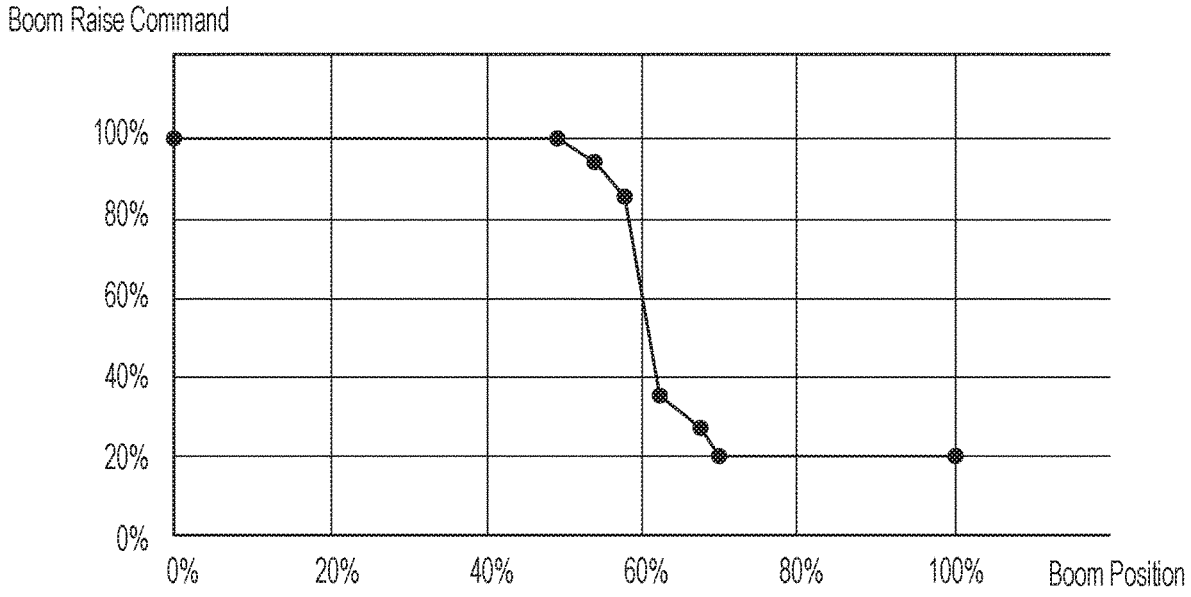
FIG. 10 is graph showing a third example of a deration of a boom raise command relative to the boom height.

FIGS. 8-10 each show a graph depicting an exemplary flow deration of the boom raise command as the boom is approaching the adjusted maximum height. FIG. 8 shows the boom raise command is derated starting at approximately 60% of the adjusted maximum height. The boom raise command is derated linearly at a first slope between 60% and approximately 70% of the adjusted maximum height, and then derated linearly at a second slope between approximately 70% of the adjusted maximum height to 100%, where the command is derated to 0% at the adjusted maximum height. FIG. 9 shows the boom raise command being derated starting at approximately 50% of the adjusted maximum height. The boom raise command is derated linearly at a first slope between 50% and approximately 70% of the adjusted maximum height. The boom raise command then levels off at approximately a 10% deration. FIG. 10 shows that more points can be used to derate the boom command, and that curve fitting can be used instead of a linear reduction.

According to another exemplary embodiment, the controller 112 is configured to limit the maximum load based on the speed of the work machine. The controller 112 includes a speed stability module 123 which includes instructions that will limit the load that can be raised to the upper position of the boom arm 42 when the vehicle is traveling. The speed stability module 123 can be turned on or off by an operator, for example through operation of switch or control screen input in the cab 30. The speed stability module 123 can be used in conjunction with the height stability module 122, or the two can be used separately. In certain embodiments, the loader 10 can include a smart attachment system for the work implement 40 that recognizes the type of work implement (e.g., bucket, fork) and enables the height stability 122 and/or the speed stability 123 automatically.

Figure 11:
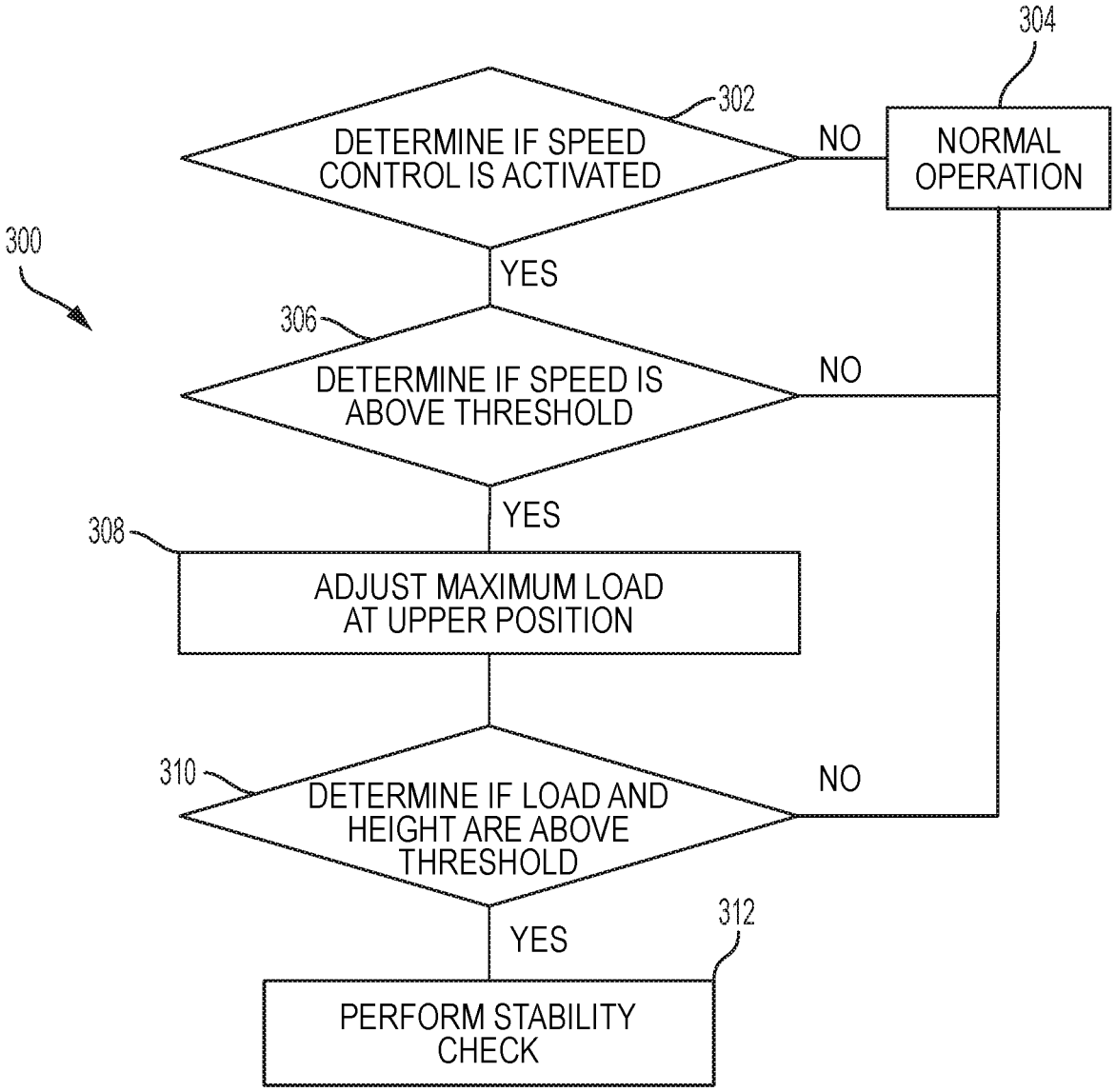
FIG. 11 is a flow chart of an exemplary height stability control module for the hydraulic system.

FIG. 11 shows a partial flow diagram of the instructions 300 to be executed by the controller 112 for the speed stability control. The controller 112 determines if the speed stability control is activated (step 302). If the speed stability control is not activated, the controller 112 proceeds under normal operation (step 304) and sends the control signal to the valve 108. If the speed stability module is activated, the controller 112 determines if the speed is above a threshold value (step 306) based on the signal received from the speed sensor 121. If the speed is below a threshold value, the controller 112 proceeds under normal operation (step 304) and sends the control signal to the valve 108. If the load is above the threshold value, the controller 112 adjusts the maximum load at an upper position of the boom (step 308). The controller 112 then determines if the load and the height are above the adjusted threshold values (step 310). If the load and the height are below the threshold values, the controller 112 proceeds under normal operation (step 304) and sends the control signal to the valve 108. If the load and the height are above the threshold values, the controller performs a stability check (step 312). The stability check can include alerting an operator, slowing or stopping movement of the loader 10, lowering the boom 42, any combination thereof, or any other operation to warn a user to increase the stability of the loader 12 without causing an unsafe condition.

The speed threshold value can be any speed (above 0 kph), resulting in a reduction of the maximum load in the upper position during any movement of the loader 10. In an exemplary embodiment, a first threshold is established for speeds between 0 kph and approximately 4 kph. At the first threshold the load that can be lifted to the full boom height is approximately 80% of the maximum load. A second threshold is established for speeds greater than approximately 4 kph. At the second threshold the load that can be lifted to the full boom height is approximately 60% of the maximum load.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances or resolutions associated with manufacturing, assembly, and use of the described embodiments and components.

What is claimed:

1. A work machine comprising:

a mechanical arm;

a work implement coupled to the mechanical arm, the work implement configured to receive a load;

a hydraulic actuator coupled to the mechanical arm to move the arm between a lower position and an upper position, wherein a distance between the lower position and the upper position is a travel distance of the mechanical arm;

a sensor unit configured to sense the load in the work implement;

a valve in fluid communication with the hydraulic actuator for supplying a fluid output to the hydraulic actuator; and a controller in communication with the valve and the sensor unit, wherein the controller is configured to transmit a control signal to the valve to adjust the fluid output to the hydraulic actuator, and wherein the controller is configured to adjust the upper position to reduce the travel distance in response to the load being at or above a threshold value, and the controller is configured to determine if the mechanical arm is within an upper portion of the reduced travel distance and to derate the fluid output of the valve a non-zero amount when the mechanical arm is in the upper portion of the reduced travel distance, and wherein the travel distance is continuously between a first threshold value and a second threshold value greater than the first threshold value.

2. The work machine of claim 1, wherein the sensor unit includes a pressure sensor operatively connected to the hydraulic actuator.

3. The work machine of claim 1, wherein the the fluid output is derated linearly at a portion within the reduced travel distance.

4. The work machine of claim 1, wherein the first threshold is approximately 50% of a maximum load and the second threshold is approximately 100% of the maximum load.

5. The work machine of claim 1, wherein the first amount is 50% of the travel distance and the second amount is 20% of the travel distance.

6. The work machine of claim 1, further comprising a speed sensor in communication with the controller and configured to detect a ground speed of the work machine, wherein the controller is configured to adjust a maximum load in response to the speed of the work machine being above a speed threshold value.

7. The work machine of claim 1, wherein the controller is a vehicle control unit.

8. The work machine of claim 1, wherein the controller is configured to derate the fluid output a first amount when the mechanical arm is at a first position in the upper portion and derate the fluid output a second amount greater than the first amount when the mechanical arm is at a second position in the upper portion that is closer to the upper position than the first position.

9. A work vehicle comprising:

a mechanical arm;

a work implement coupled to the mechanical arm, the work implement configured to receive a load;

a hydraulic actuator coupled to the mechanical arm to move the arm between a lower position and an upper position, wherein a distance between the lower position and the upper position is a travel distance of the mechanical arm;

a load sensor configured to detect the load in the work implement;

a position sensor configured to detect the position of the mechanical arm;

a valve in fluid communication with the hydraulic actuator for supplying a fluid output to the hydraulic actuator; and a controller in communication with the valve, the load sensor, and the position sensor, wherein the controller is configured to adjust the upper position to reduce the travel distance in response to the load being at or above a load threshold value, and the controller is configured to determine if the mechanical arm is within an upper portion of the reduced travel distance and to derate the fluid output of the valve a non-zero amount when the mechanical arm is in the upper portion of the reduced travel distance, and wherein the travel distance is continuously between a first threshold value and a second threshold value greater than the first threshold value.

10. The work vehicle of claim 9, wherein the upper portion of the reduced travel distance is within the top 25% of the reduced travel distance.

11. The work vehicle of claim 9, wherein derating the fluid output reduces a movement speed of the mechanical arm as it approaches the upper position.

12. The work vehicle of claim 9, further comprising a speed sensor in communication with the controller and configured to detect a ground speed of the work machine, wherein the controller is configured to adjust a maximum load in response to the ground speed of the work machine being above a speed threshold value.

13. The work vehicle of claim 12, wherein the controller is configured to perform a stability check if the mechanical arm is in the upper position and the speed is above the speed threshold value.

14. The work vehicle of claim 13, wherein the stability check includes one of an operator alert, slowing the speed of the vehicle, or lowering the mechanical arm.

15. A method of controlling stability during operation of a work vehicle, the work vehicle including a mechanical arm, a work implement coupled to the mechanical arm and configured to receive a load, a hydraulic actuator coupled to the mechanical arm to move the arm between a lower position and an upper position, wherein a distance between the lower position and the upper position is a travel distance of the mechanical arm, a sensor unit, and a valve in fluid communication with the hydraulic actuator for supplying a fluid output to the hydraulic actuator, the method comprising:

receiving a request to move the mechanical arm from an operator input;

receiving a work implement load value from a sensor unit;

determining if the load value is at or above a load threshold value;

adjusting the upper position of the mechanical arm to reduce the travel distance in response to the load being at or above the load threshold value, determining if the mechanical arm is within an upper portion of the reduced travel distance, and derating the fluid output of the valve a non-zero amount when the mechanical arm is within an upper portion of the reduced travel distance, wherein the travel distance is continuously reduced between a first load threshold value and a second load threshold value greater than the first threshold value.

16. The method of claim 15, wherein the the fluid output is derated linearly at a portion within the reduced travel distance.

17. The method of claim 15, wherein derating the fluid output reduces a movement speed of the mechanical arm as it enters the top 15% of the reduced travel distance.

18. The method of claim 15, further comprising receiving a vehicle speed from the sensor unit, and adjusting the maximum load in response to the speed of the work machine being above a speed threshold value.

19. The method of claim 18, further comprising performing a stability check if the mechanical arm is in the upper position and the speed is above the speed threshold value, wherein the stability check includes one of an operator alert, slowing the speed of the vehicle, or lowering the mechanical arm.

* * * * *